US009004439B2

(12) United States Patent
Gross et al.

(10) Patent No.: US 9,004,439 B2
(45) Date of Patent: Apr. 14, 2015

(54) POST ANCHOR

(75) Inventors: John Gross, Vancouver (CA); Simon Walker, Surrey (CA); Frank Fan, Surrey (CA); Wei Min Zhu, Surrey (CA)

(73) Assignee: Peak Innovations Inc., Richmond (CA)

( * ) Notice: Subject to any disclaimer, the term of this patent is extended or adjusted under 35 U.S.C. 154(b) by 879 days.

(21) Appl. No.: 11/278,647

(22) Filed: Apr. 4, 2006

(65) Prior Publication Data

US 2007/0235616 A1 Oct. 11, 2007

(51) Int. Cl.
*F16M 13/00* (2006.01)
*E04H 12/22* (2006.01)

(52) U.S. Cl.
CPC ..... *E04H 12/2269* (2013.01); *E04H 12/2261* (2013.01)

(58) Field of Classification Search
USPC ..... 248/507, 500, 511, 519; 411/84, 372.5; 52/296, 736.1, 736.3, 736.4, 738.1; 256/65.14
See application file for complete search history.

(56) References Cited

U.S. PATENT DOCUMENTS

| | | | | |
|---|---|---|---|---|
| 611,452 | A | 9/1898 | Hoover | |
| 723,669 | A | 3/1903 | Hammann | |
| 769,976 | A | 9/1904 | Zimmermann | |
| 842,604 | A | 1/1907 | Zimmermann | |
| 1,090,171 | A | 3/1914 | Schisler | |
| 1,214,738 | A | 2/1917 | Wolf | |
| 2,097,600 | A | 11/1937 | Pavlecka | |
| 2,277,587 | A | 3/1942 | Gustafson | |
| 2,756,999 | A * | 7/1956 | Orsatti | 473/499 |
| 3,083,951 | A | 4/1963 | Huret | |
| 3,166,299 | A | 1/1965 | De Chellis | |
| 3,267,627 | A | 8/1966 | Hammitt | |
| 3,304,683 | A | 2/1967 | Ferreira | |
| 3,415,475 | A | 12/1968 | Goodman | |
| 3,420,504 | A | 1/1969 | Mulitz | |
| 3,463,456 | A | 8/1969 | Walker | |
| 3,484,081 | A | 12/1969 | Rowan | |
| 3,491,984 | A | 1/1970 | Nyberg | |
| 3,633,862 | A | 1/1972 | Breen | |
| 3,809,346 | A | 5/1974 | Jackson | |
| 3,875,699 | A | 4/1975 | Lamarre | |
| 3,918,686 | A | 11/1975 | Knott et al. | |
| 3,924,834 | A | 12/1975 | Young | |
| 3,955,800 | A | 5/1976 | Russo | |
| 3,957,250 | A | 5/1976 | Murphy | |
| 4,038,802 | A | 8/1977 | Bajorek et al. | |

(Continued)

FOREIGN PATENT DOCUMENTS

| | | |
|---|---|---|
| CA | 1041337 | 10/1978 |
| CA | 1055289 | 5/1979 |

(Continued)

*Primary Examiner* — Steven Marsh
(74) *Attorney, Agent, or Firm* — Todd Rattray; Oyen Wiggs; Green & Mutala LLP

(57) ABSTRACT

A post anchor for securing a support post for a structure comprises a base with four upstanding sidewalls forming a cavity into which a post is inserted, and means to secure the post inside the cavity. Interior ribs and exterior augmented corners resist deformation under pressure exerted by the post. Interior channels allow water to drain from inside the cavity toward a drain hole. The anchor post is slightly elevated relative to the ground, allowing air and water to circulate around the post and post anchor. The post anchor is made of a thermoplastic polymer which is given a textured surface, and may include an ultraviolet protection additive.

11 Claims, 5 Drawing Sheets

(56) References Cited

U.S. PATENT DOCUMENTS

| | | | | |
|---|---|---|---|---|
| 4,050,828 | A | 9/1977 | Noro | |
| 4,269,534 | A | 5/1981 | Ryan | |
| 4,346,872 | A | 8/1982 | Tornya | |
| 4,381,160 | A | 4/1983 | Grimm et al. | |
| 4,429,497 | A * | 2/1984 | Dibernardi | 52/27 |
| 4,596,489 | A * | 6/1986 | Mariol et al. | 404/10 |
| 4,809,955 | A | 3/1989 | Veilleux | |
| 4,923,164 | A | 5/1990 | Stenberg | |
| D348,738 | S | 7/1994 | Jasinsky | |
| 5,364,076 | A | 11/1994 | Nicholls | |
| 5,375,384 | A | 12/1994 | Wolfson | |
| 5,568,909 | A * | 10/1996 | Timko | 248/519 |
| 5,713,171 | A | 2/1998 | Andres | |
| 5,852,895 | A * | 12/1998 | Sinanan | 47/33 |
| 6,003,826 | A | 12/1999 | Galloway, III | |
| 6,053,481 | A | 4/2000 | Scheide | |
| 6,061,991 | A | 5/2000 | Dahl | |
| 6,141,928 | A | 11/2000 | Platt | |
| 6,182,394 | B1 * | 2/2001 | Bassler | 47/65.5 |
| 6,213,452 | B1 | 4/2001 | Pettit et al. | |
| D443,937 | S | 6/2001 | Prokop | |
| 6,258,465 | B1 | 7/2001 | Oka | |
| 6,282,861 | B1 | 9/2001 | Natelli, Jr. | |
| 6,336,620 | B1 * | 1/2002 | Belli | 248/519 |
| 6,446,930 | B1 | 9/2002 | Li | |
| 6,467,756 | B1 | 10/2002 | Elsasser | |
| 6,568,145 | B2 | 5/2003 | Bartel | |
| 6,640,517 | B2 * | 11/2003 | Mitchell | 52/298 |
| 6,702,259 | B2 | 3/2004 | Pratt | |
| 6,712,330 | B1 * | 3/2004 | Damiano | 248/519 |
| 6,718,710 | B2 | 4/2004 | Platt | |
| 6,729,089 | B1 | 5/2004 | Spragg | |
| 6,735,916 | B2 | 5/2004 | Peshkam et al. | |
| 6,742,748 | B1 * | 6/2004 | Gretz | 248/156 |
| 2,820,262 | A1 | 3/2005 | Dunn | |
| 6,863,253 | B2 | 3/2005 | Valentz | |
| D503,813 | S | 4/2005 | Steffes et al. | |
| 6,988,700 | B2 * | 1/2006 | Cote | 248/519 |
| 7,455,282 | B2 * | 11/2008 | Platt | 256/59 |
| 2002/0040956 | A1 | 4/2002 | Carnahan et al. | |
| 2003/0234391 | A1 | 12/2003 | Sheppard et al. | |
| 2004/0222338 | A1 | 11/2004 | Curtis | |
| 2005/0016085 | A1 | 1/2005 | Saldarelli et al. | |
| 2006/0059812 | A1 | 3/2006 | Simmons | |
| 2007/0187564 | A1 | 8/2007 | McGuire | |
| 2008/0222973 | A1 * | 9/2008 | Lee et al. | 52/126.1 |

FOREIGN PATENT DOCUMENTS

| | | |
|---|---|---|
| CA | 1146393 | 5/1983 |
| CA | 1178096 | 11/1984 |
| CA | 1223472 | 6/1987 |
| CA | 2218466 | 6/1998 |
| CA | 2274263 | 6/2000 |
| CA | 2277587 | 7/2000 |
| CA | 2387296 | 11/2002 |
| DE | 29607423 | 6/1996 |
| EP | 0984118 A2 | 3/2000 |
| GB | 1461802 | 1/1977 |
| NZ | 242387 | 5/1994 |
| WO | 9113222 | 9/1991 |
| WO | WO 03/000022 | 1/2003 |
| WO | WO 2004/090264 | 10/2004 |

* cited by examiner

POST ANCHOR

FIELD OF THE INVENTION

This invention relates to post anchors of a type used to secure a support post for a structure, such as a deck, fence or other structure requiring vertical or horizontal support posts.

BACKGROUND OF THE INVENTION

One form of post anchor according to the prior art comprises a base with four upstanding sidewalls and means such as screws to attach the post anchor to a post within the cavity defined by the sidewalls. Such a post anchor is described in U.S. Pat. No. 6,729,089 issued May 4, 2004 to Spragg.

One difficulty encountered with prior art post anchors is that water, such as rainwater, tends to run down the post and collect at the base, inside and around the post anchor cavity. Standing water or simply contact with wet ground around or inside the base of a post may cause the anchored post to rot, warp or corrode or may otherwise damage the post. Damage to the post may then destabilize any structure supported by the post.

If the post anchor is made of metal, standing water inside or around the post anchor cavity may also corrode the base and sidewalls of the post anchor, eventually leading to failure and destabilization of the supported structure. For this reason, it is known to provide a coating to the post anchor to prevent corrosion.

However, an additional difficulty with prior art post anchors is that, particularly in the case of a wood post, the post tends to absorb water and will accordingly swell, or the post may simply shorten and expand over time under the weight of the structure being supported. In both cases, the post circumference increases and exerts excess pressure from inside the cavity of the post anchor. This pressure may deform the post anchor, and may also cause any corrosion-resistant coating to crack. Under repeated swelling cycles as the post gets wet, then dries off, the cracked corrosion-resistant coating will peel or flake off and the post anchor itself will also eventually fail. Apart from the coating failure, a prior art post anchor may still fail under repeated post swelling cycles, due to fatigue in the post anchor material from the changes in pressure exerted by the post.

Exposure to elements besides water can also cause difficulties, as ultraviolet rays may cause the post anchor material to break down and eventually fail. It is therefore desirable to provide a post anchor with some protection from ultraviolet rays.

Aesthetically, it is often preferable to use a post anchor with an appearance that blends into that of the post being supported, and/or into the ground or surface on which the post anchor is mounted.

It is therefore an object of the invention to provide an improved post anchor which overcomes the above limitations and provides other desirable features.

This and other objects of the invention will be appreciated by reference to the summary of the invention and to the detailed description of the preferred embodiment that follow.

SUMMARY OF THE INVENTION

According to one aspect of the invention, the post anchor is made from a thermoplastic polymer such as polyethylene, preferably with additives to enhance the ultraviolet resistance of the polymer. The polymer is textured to provide a grainy appearance, similar to a wood grain or other natural grain.

In another aspect of the invention, channels are provided on the inside upper surface of the base inside the post anchor to allow water to flow toward a drain hole extending through the center of the base. The base of the post anchor is elevated off the ground by shallow feet or extensions to allow the circulation of air or water under the post.

In yet another aspect of the invention, interior ribs extend medially along the vertical extent of each wall to limit deformation of the post anchor under pressure from the post as it expands.

In a further aspect of the invention, the corners of the post anchor may be thicker than the walls, thereby strengthening the post anchor and reducing the chance of failure due to expansion of the post inside the post anchor.

In one aspect, the invention comprises a post anchor, having a base with an upper surface and an underside and a plurality of upstanding sidewalls supported on the upper surface of the base and defining a cavity, where each sidewall abuts two other sidewalls to form two corners and there is an increased thickness about each of the corners. The increased thickness may be exterior to the cavity.

In another aspect, the invention comprises a post anchor, having a base with an upper surface and an underside, a plurality of upstanding sidewalls supported on the base and defining a cavity, and one or more interior ribs on each sidewall. In a more particular aspect, there may be two interior ribs spaced along the sidewall, and the ribs may extend perpendicularly to the base.

In yet another aspect, the invention comprises a post anchor, with a base having an upper surface and an underside, a plurality of upstanding sidewalls supported on the upper surface of the base and defining a cavity, at least one drain hole extending through the base and a plurality of channels on the upper surface of the base, the channels communicating with the drain hole.

In another aspect, the invention comprises a post anchor, having a base comprising an upper surface and an underside and a plurality of upstanding sidewalls supported on the upper surface of the base and defining a cavity, and a plurality of supports depending from the underside of the base. The supports may comprise an extension at each corner.

In another aspect, the invention comprises a post anchor, having a base comprising an upper surface and an underside and a plurality of upstanding sidewalls supported on the upper surface of the base and defining a cavity, a plurality of supports depending from the underside of the base, each of the sidewalls abutting two other sidewalls to form two corners, wherein the sidewalls have an increased thickness about each of the corners and each sidewall further comprises one or more interior ribs, and the base has at least one drain hole extending through the base and a plurality of channels on the upper surface of the base, the channels communicating with the drain hole.

In a further aspect of the invention, the base and sidewalls may be made of a thermoplastic polymer. The polymer may be polyethylene and may further contain an ultraviolet resistant additive blended with the polyethylene. In yet a further aspect, the polymer may have a textured surface.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENTS OF THE INVENTION

Figure 1:
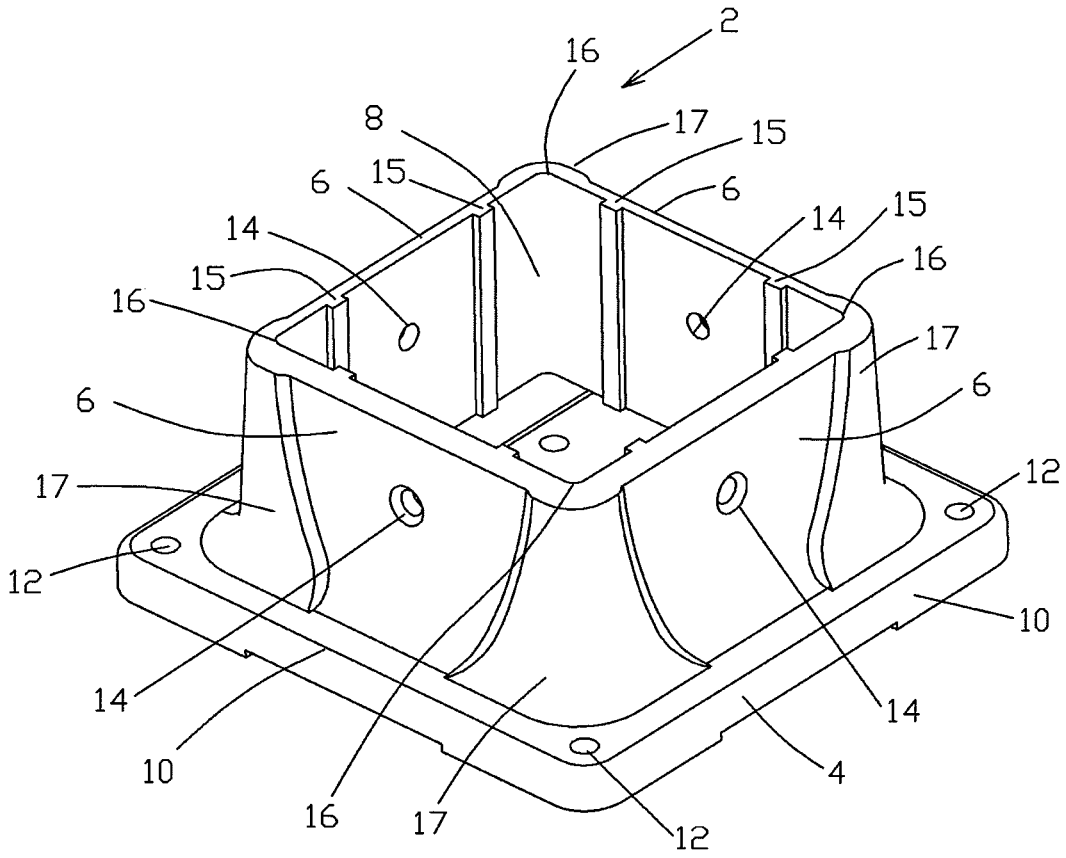
FIG. 1 is a perspective view of the post anchor according to the preferred embodiment.

FIG. 1 is a perspective view of a preferred embodiment of the post anchor 2. The post anchor 2 is preferably made of a thermoplastic polymer, such as polyethylene, which is easy to form to the proper shape, corrosion-resistant, waterproof, strong, lightweight, and relatively inexpensive. The polyethylene surface can also be worked during the forming process to provide a rough, grainy texture, similar to the wood posts which the post anchor may support. Polyethylene is also available in many colours, which can be mixed to provide or enhance the appearance of an irregular, grainy surface, or otherwise selected to blend into the area where the post anchor is being used. Finally, polyethylene is easily modified to include additives, such as ultraviolet protectors, which may be useful for outdoor applications.

Post anchor 2 comprises a base 4, supporting four upstanding sidewalls 6, which define a cavity 8. Walls 6 may be placed anywhere on base 4, to provide a cavity 8 of various dimensions, such as 4"×4" or any other desired size and shape to accommodate various posts. Walls 6 are preferably spaced inward from the edges 10 of base 4, to leave space for attachment holes 12 near the edges 10. Screws or other fastening devices may be inserted into attachment holes 12 to secure the post anchor 2 to a deck, floor or any other suitable support.

Walls 6 intersect at corners 16, which may comprise a thicker layer 17 of material as an external augmentation method to strengthen the post anchor 2 at the corners of cavity 8. It will be understood that other reinforcing methods may also be used to strengthen the post anchor 2 in the corners 16 where walls 6 intersect.

Figure 4:
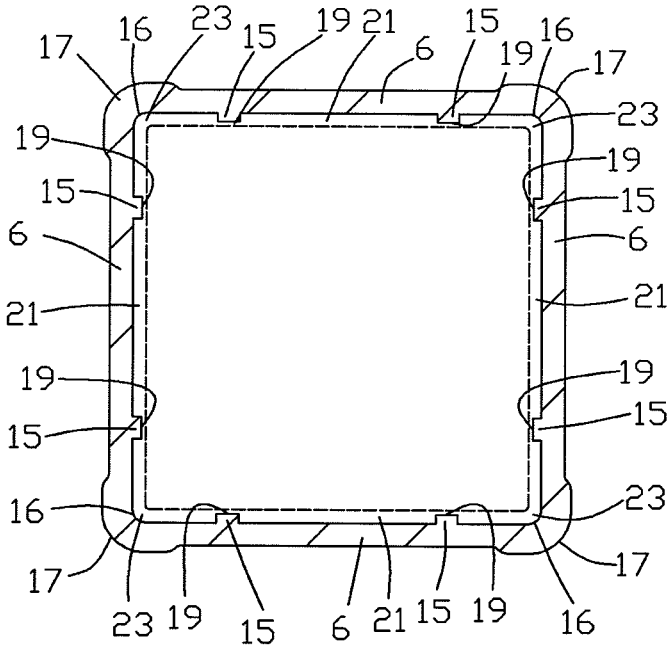
FIG. 4 is a sectional view along line 4-4 of FIG. 2.
Figure 3:
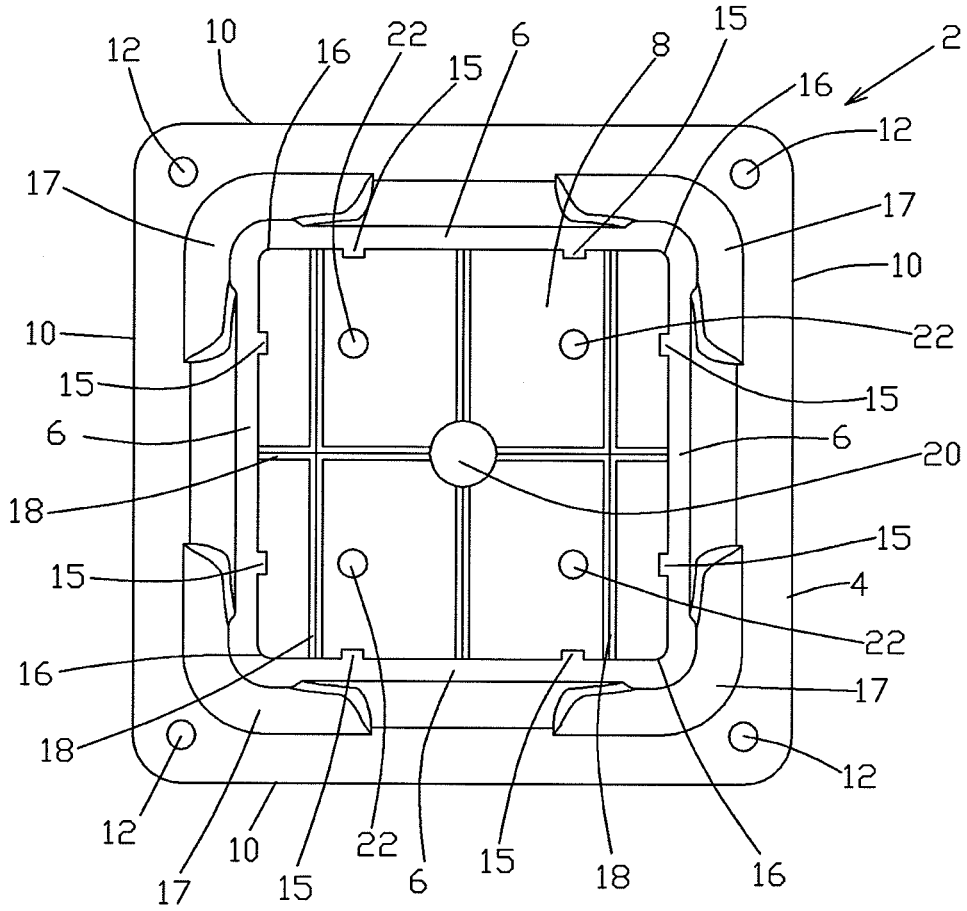
FIG. 3 is a top view thereof.

As best shown in FIG. 3, each wall 6 may also include one or more interior ribs 15 to provide expansion space in cavity 8 for an inserted post to swell. Each wall preferably contains a pair of interior ribs 15. The maximum size of the post which may be inserted into cavity 8 is normally defined by the front faces 19 of each interior rib 16, as illustrated by the dotted line in FIG. 4. However, the post anchor 2 provides expansion room for the post in spaces 21 in the center of each wall 6 between the interior ribs 15. Further expansion room is available in spaces 23 in the corners of the cavity 8.

Figure 2:
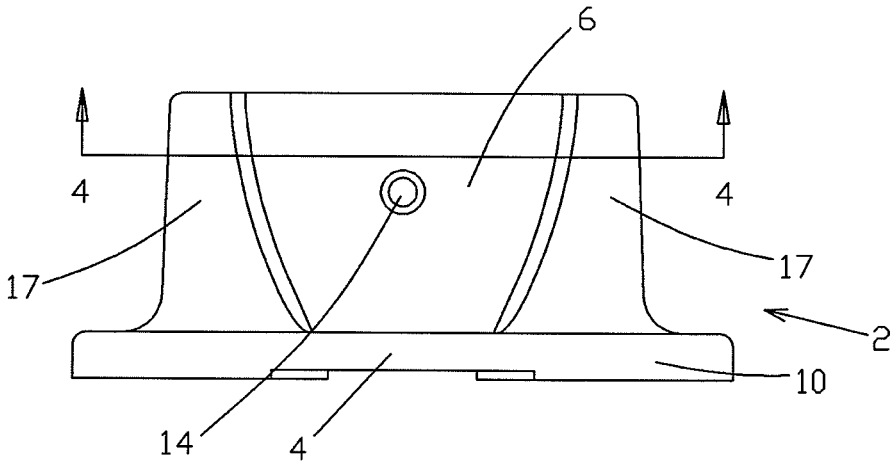
FIG. 2 is an elevation view thereof.

As best seen in FIG. 2, each wall 6 may contain a hole 14, into which a screw or other fastening device may be inserted to secure a post (not shown) in cavity 8. Base 4, which is best seen in FIG. 3, may also comprise one or more holes 22, through which screws or other fastening devices may be inserted from the underside of base 4 to secure a post (not shown) in cavity 8.

The upper surface of base 4 inside cavity 8 contains one or more interior channels 18. Base 4 also includes a drain hole 20. Water that accumulates inside the cavity 8 will collect in an interior channel 18 and eventually drain out of the cavity 8 through the network of interior channels 18 and drain hole 20.

Figure 5:
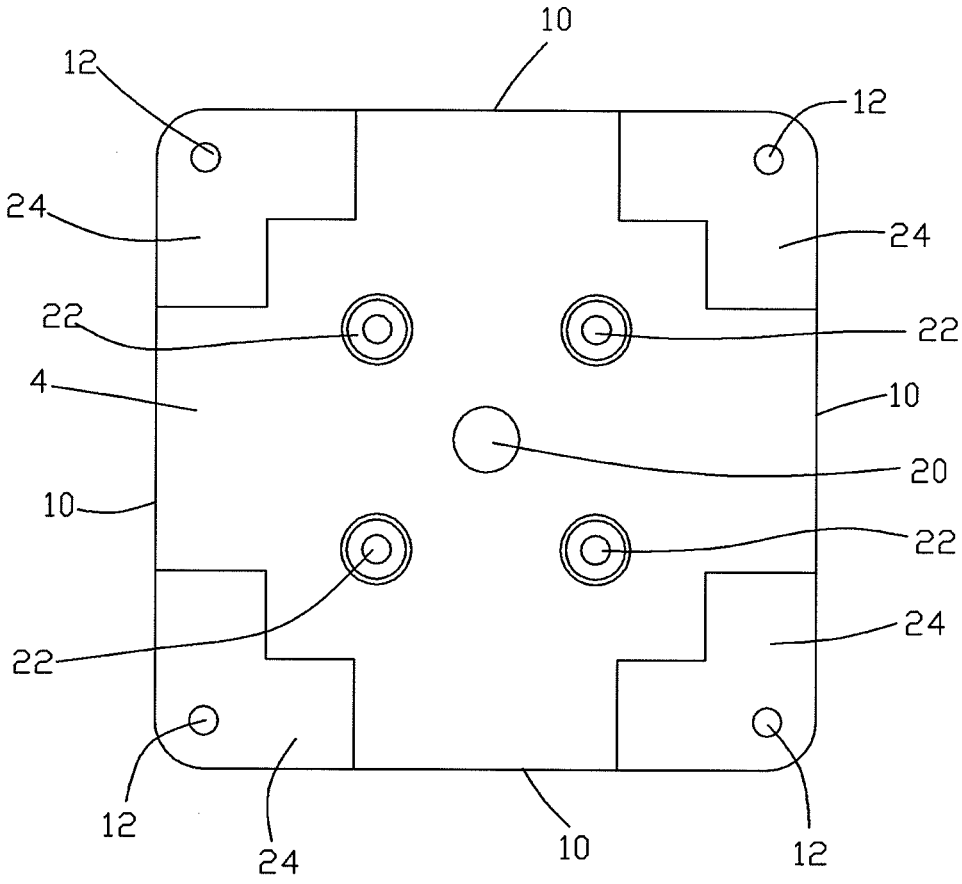
FIG. 5 is a bottom view of the post anchor according to the preferred embodiment.

The underside of base 4 is best shown in FIG. 5. Around each attachment hole 12, or at any other suitable location, an elevated support 24 removes the post anchor 2 from direct contact with the surface to which the post anchor is attached. This allows better drainage of water through drain hole 20, as well as allowing air and water to circulate underneath the base 4. This keeps the post and post anchor 2 away from shallow puddled water and allows the underside of the post and post anchor 2 to dry faster, if they do get wet. Preferably the elevated supports 24 are shallow extensions or feet.

Figure 6:
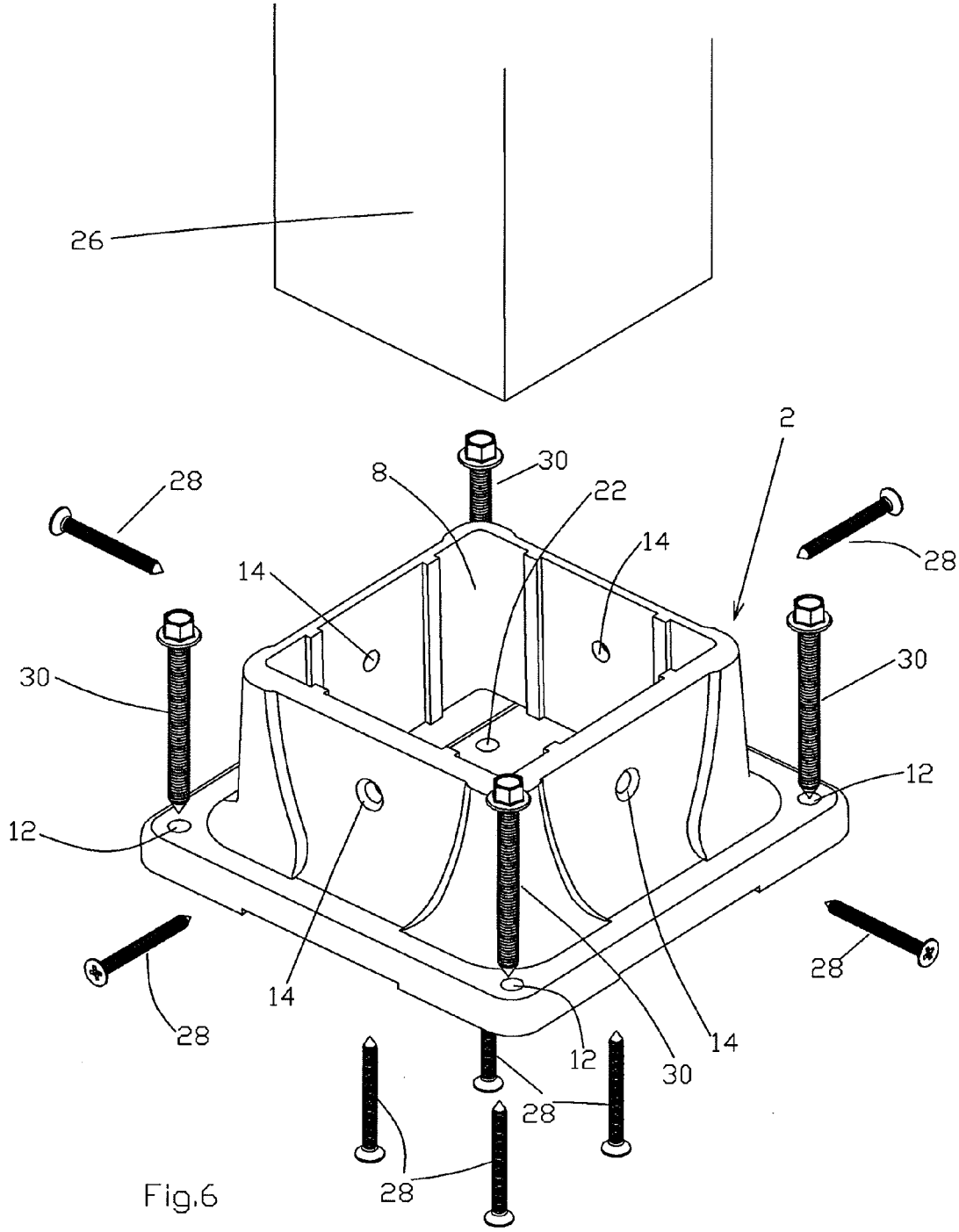
FIG. 6 is an exploded perspective view of the post anchor and a post according to the preferred embodiment.

FIG. 6 shows the post anchor 2 as it would be assembled with a post 26. Post 26 is inserted in cavity 8 and screws or other fastening devices 28 are inserted through holes 14 and 22 to secure the post within the cavity 8. The post anchor 2 and the post 26 may then be secured to any suitable surface by insertion of screws or other fastening devices 30 through attachment holes 12 in base 4.

It will be appreciated by those skilled in the art that other variations to the preferred embodiments described herein may be practiced without departing from the scope of the invention, such scope being properly defined by the following claims.

The invention claimed is:

1. A post anchor comprising:

a base having an upper surface and an underside;

a plurality of upstanding sidewalls supported on said upper surface of said base;

each of said sidewalls abutting two other of said sidewalls to form two corners;

the sidewalls extending substantially straight upwardly from the upper surface of the base to define, together with the upper surface of the base, an upwardly opening concavity, a perimeter of an opening of the upwardly opening concavity defined by uppermost edges of the concavity-defining interior surfaces of the substantially straight upwardly extending sidewalls; and wherein said sidewalls have an increased thickness about each of said corners, wherein the increased thickness about each of the corners comprises a lower region of increased thickness proximate the base and an upper region of increased thickness proximate the uppermost edges of the sidewalls and wherein the lower region extends further from the corner and along the abutting sidewalls that form the corner than the upper region wherein said increased thickness is exterior to said upwardly opening cavity; and further comprising a plurality of first apertures defining first passageways through at least one of said side walls into said upwardly opening concavity, said first passageways configured to receive fasteners for securing said post anchor to a support post inserted into said upwardly opening concavity; a plurality of second apertures defining second passageways from said underside of said base into said upwardly opening concavity, said second passageways configured to receive fasteners for securing said base to said support post; and a plurality of third apertures defining third passageways outside said upwardly opening concavity from said upper surface of said base through said underside of said base, said third passageways configured to receive fasteners for securing said base to a flat surface; wherein each of said sidewalls comprises one or more interior ribs, wherein, for each of the sidewalls, the one or more interior ribs extend from a concavity-defining interior surface of the sidewall into the concavity, and said ribs comprising front surfaces spaced further apart from the cavity-defining interior surface of said sidewall than any other part of said ribs and extending upwardly from the base in a direction perpendicular to the base.

2. A post anchor comprising:

a base having an upper surface and an underside;

a plurality of upstanding sidewalls supported on said upper surface of said base and extending upwardly therefrom to define, together with the upper surface of the base, an upwardly opening concavity therebetween shaped for receiving a post; and each of said sidewalls further comprising one or more interior ribs, wherein, for each of the sidewalls, the one or more interior ribs extend from a concavity-defining interior surface of the sidewall into the concavity wherein, for each of the sidewalls, the one or more interior ribs comprise two interior ribs spaced apart from one another along said sidewall, said ribs comprising front surfaces spaced further apart from the cavity-defining interior surface of said sidewall than any other part of said ribs and extending upwardly from the base in a direction perpendicular to said base, a spacing between the two interior ribs sufficient to provide expansion space in said upwardly opening concavity for a post inserted into said upwardly opening concavity to swell; wherein, for each of the sidewalls, the spacing between the two interior ribs is greater than ⅓ of a corner-to-corner length of the corresponding sidewall.

3. A post anchor comprising:

a multiple-cornered base comprising a plurality of base corners, an upper surface and an underside;

a plurality of upstanding sidewalls supported on said upper surface of said base;

a plurality of support extensions, each support extension extending downwardly from said underside of said base at a corresponding one of the base corners and extending from the corresponding one of the base corners along both peripheral edges of the base that define the corresponding one of the base corners;

each of said sidewalls abutting two other of said sidewalls to form two corners;

the sidewalls extending substantially straight upwardly from the upper surface of the base to define, together with the upper surface of the base, an upwardly opening concavity, a perimeter of an opening of the upwardly opening concavity defined by the uppermost edges of the concavity-defining interior surface of the substantially straight upwardly extending sidewalls;

wherein said sidewalls have an increased thickness about each of said corners, wherein the increased thickness about each of the corners comprises a lower region of increased thickness proximate the base and an upper region of increased thickness proximate the uppermost edges of the sidewalls and wherein the lower region extends further from the corner and along the abutting sidewalls that form the corner than the upper region;

each of said sidewalls further comprising one or more interior ribs, wherein, for each of the sidewalls, the one or more interior ribs extend from a concavity-defining interior surface of the sidewall into the concavity;

at least one drain hole extending through said base at a location on the base within the upwardly opening concavity; and a plurality of channels on said upper surface of said base at locations on the upper surface of the base within said upwardly opening concavity, wherein said channels communicate with said drain hole.

4. The post anchor of claim 1 wherein said base and said sidewalls are made of a thermoplastic polymer comprising an ultraviolet resistant additive blended with polyethylene.

5. The post anchor of claim 1 wherein the base comprises multiple base corners, each of the base corners defined by a pair of peripheral edges of the base, and wherein the post anchor further comprises a plurality of support extensions, each support extension extending downwardly from said underside of said base at a corresponding one of the base corners and extending from the corresponding one of the base corners along both peripheral edges of the base that define the corresponding one of the base corners, said support extensions configured to abut said ground while permitting the circulation of air and water between said underside and said ground.

6. The post anchor of claim 5 further comprising at least one drain hole extending through said base at a location within the upwardly opening concavity.

7. The post anchor of claim 6 further comprising a plurality of channels on said upper surface of said base at locations within the upwardly opening concavity wherein said channels communicate with said drain hole.

8. A post anchor according to claim 3 wherein, for each of the sidewalls, the spacing between the two interior ribs is greater than ⅓ of a corner-to-corner length of the corresponding sidewall.

9. A post anchor according to claim 3 wherein each of the support extensions is shaped to define a fastener-receiving aperture which extends therethrough.

10. A post anchor according to claim 1 wherein at least a portion of the lower region of increased thickness has a thickness greater than the upper region of increased thickness.

11. A post anchor according to claim 3 wherein at least a portion of the lower region of increased thickness has a thickness greater than the upper region of increased thickness.

* * * * *